United States Patent [19]

Curtin

[11] 4,287,051

[45] Sep. 1, 1981

[54] DISPOSITION OF A HIGH NITROGEN CONTENT OIL STREAM

[75] Inventor: Daniel J. Curtin, Plano, Tex.

[73] Assignee: Atlantic Richfield Company, Los Angeles, Calif.

[21] Appl. No.: 92,553

[22] Filed: Nov. 8, 1979

[51] Int. Cl.[3] ..... C10G 67/04; C10G 45/02

[52] U.S. Cl. ..... 208/254 H; 208/282; 208/326; 423/650

[58] Field of Search ..... 208/254 H, 254 R, 265, 208/279-282, 326, 87, 90, 88, 89, 96, 98; 423/650

[56] References Cited

U.S. PATENT DOCUMENTS

| | | | |
|---|---|---|---|
| 2,263,175 | 11/1941 | Lazar et al. | 208/326 X |
| 2,309,324 | 1/1943 | McAllister et al. | 208/282 X |
| 2,541,458 | 2/1951 | Berg | 260/705 |
| 2,662,843 | 12/1953 | Castner et al. | 208/282 X |
| 2,704,758 | 3/1955 | Wetzel | 546/181 |
| 3,380,910 | 4/1968 | Griffiths | 208/58 |
| 3,523,071 | 8/1970 | Knapp et al. | 208/14 |
| 3,537,977 | 11/1970 | Smith | 208/89 |
| 4,115,246 | 9/1978 | Sweany | 208/56 |
| 4,159,940 | 7/1979 | Smith | 208/254 H |

*Primary Examiner*—Delbert E. Gantz
*Assistant Examiner*—G. E. Schmitkons
*Attorney, Agent, or Firm*—James C. Fails

[57] ABSTRACT

A method of denitrogenating viscous oils containing a relatively high content of nitrogenous compounds and of disposing of a resulting high nitrogen content oil stream, characterized by forming a raw oil stream and a first viscous bottoms stream that would not be operably pumpable to a partial oxidation unit without the inclusion of viscosity lowering constituents; extracting the nitrogenous compounds from the raw oil stream with an operable acid solvent to produce a raffinate oil of low nitrogen content oil and an extract stream of low viscosity, high nitrogen content oil; recovering the acid solvent from the extract stream, simultaneously producing a small volume stream of low viscosity, high nitrogen content oil; admixing the low viscosity high nitrogen content oil with the high viscosity bottoms stream to provide a pumpable mixed stream; sending the mixed stream to a partial oxidation unit to produce hydrogen; employing the produced hydrogen for hydrogenation of the raffinate oil at mild conditions; and recycling the acid solvent to the extraction step. Additional and alternative steps are also disclosed.

11 Claims, 4 Drawing Figures

DISPOSITION OF A HIGH NITROGEN CONTENT OIL STREAM

FIELD OF THE INVENTION

This invention relates to a method of removing and disposing of catalyst-poisoning impurities, or contaminants; such as nitrogen-containing compounds; from hydrocarbonaceous fluids, or oils; such as synthetic crude oil, synthetic oils derived from coal and shale and the like.

DESCRIPTION OF THE PRIOR ART

The prior art has included the development of many types of energy. With the current scarcity and projected shortage of fossil fuel sources of energy, there has been a resurgence of interest in sources of energy that were formerly not competitive. These sources of energy include the shale oil, or kerogen, such as derived from oil shale; the fluids, such as coal liquids or methanol or coal gas, that are synthesized from coal; and bitumen from tar sands and the like. Many of these hydrocarbonaceous fluids contain contaminants that need to be removed before further processing. Typical of these contaminants are nitrogen-containing compounds, generally referred to as the nitrogenous compounds. For example, the coal liquids contain concentrations on the order of 0.5–1.5 percent (%) by weight of the nitrogen compounds. Shale oil contains more than two percent (2%) nitrogenous compounds. The nitrogen compounds are poisons for precious metal reforming catalysts and to a lesser degree for catalytic cracking catalysts which are used in petroleum processes. The nitrogen in liquid produced from shale oil or coal liquids is partially converted to nitrogen oxides on combustion. Consequently, burning oil with the nitrogen contents in the range of raw coal liquids or shale oil could result in violation of air pollution regulations for nitrogen oxides.

The nitrogen is contained predominately in five or six member ring structures in coal liquids. Nitrogen compounds which boil above eight hundred degrees Fahrenheit (800° F.) are in multi-ring aromatic and heterocyclic structures. Aromatic ring compounds exhibit exceptional stability because of the resonance of the $\pi$ hydrogen bonds. This is also true of the heterocyclic nitrogen compounds as well. Consequently, in order to remove nitrogen from the ring structures, the carbon-nitrogen bonds must be broken by cracking. Saturated rings do not have the resonance stability of aromatic rings and, hence, rupture more easily. Experimental evidence suggests that hydrocracking of aromatic rings occurs by first, hydrogen saturation of the aromatic rings, followed by cracking. In polycyclic structures, outer rings are hydrogenated and ruptured first. The remaining single aromatic rings are very stable and are likely to remain unchanged at hydrocracking conditions.

At the high reaction severity required to hydrogenate coal or shale liquids, as well as other synthetic oils, a large amount of hydrogen is consumed in reaction with hydrocarbons present.

There are numerous patents and literature articles directed to these conditions of the hydrogenation of shale oil and coal liquids. All of these articles point out the severe hydrogenation conditions of high temperature, high hydrogen partial pressure and low space velocities that are required to reduce nitrogen contents to acceptable levels.

As disclosed by a co-worker in his U.S. Pat. No. 4,159,940 and a co-pending patent application, Ser. No. 091,548 (filed Nov. 5, 1979), entitled "DENITROGENATION OF OILS WITH REDUCED HYDROGEN CONSUMPTION", inventor Robert H. Smith, assigned to the assignee of this application, these severe hydrogen consumption and severe conditions required for denitrogenation are set forth and methods of using combinations of acid extraction and hydrogenation disclosed to circumvent these requirements. The descriptive matters of the patent and application are incorporated herein by reference for details that are omitted herefrom. The patent and application disclosed respective methods of disposing of a high nitrogen oil stream by (1) subjecting it to severe hydrogenation conditions for hydrodenitrogenating the stream and (2) sending it to a hydrogen producing plant. Each of these methods has limitations of economics and need and do nothing to solve a nagging problem of a very viscous bottoms stream from a related activity, as described hereinafter.

The bottoms from the acid extraction of these relatively high nitrogen content oil streams includes a recovered stream of oil containing high nitrogen content and having a low viscosity. The oil stream is too high in nitrogen content to be burned without the hydrotreating. Separate hydrotreating is expensive. Recycle of the high nitrogen content oil back to the hydrotreater is not attractive because the nitrogen compounds in this stream will be refractory; that is, they will be extremely stable and will remain unchanged at hydrocracking conditions. Coking of this stream is also unattractive because the nitrogen compounds are not removed in this process. A separate partial oxidation unit to produce hydrogen from such a small volume high nitrogen stream is not economically feasible. The lack of a suitable method to economically dispose of this stream has been heretofore a major obstacle to using such processes as described in the co-pending patent application, Ser. No. 091,548.

In most plants in which an extraction process is likely to be used, a very viscous bottoms stream is produced in related activity such as in the case of TOSCO II shale oil plant or in the case of an EDS coal liquids plant. Any of the conventional type plants can be employed. As is recognized, the TOSCO II plant is a rotating inclined vertical kiln unit for retorting shale oil from the shale. The EDS plant is the EXXON Donor Solvent plant for liquefying coal. The bottoms; that is, the high boiling, not readily distillable, stream of either plant, is normally sent to a coker where a significant fraction of it is converted to a solid coke, which is generally much less valuable than liquid product. A preferred method of using this large bottoms stream would be to send it to a partial oxidation unit to make either fuel gas or hydrogen which in turn could be used by those skilled in the art to effect higher overall liquid yields. However, the operability of a partial oxidation unit is limited by the viscosity of the bottoms stream. Moreover, partial oxidation units require on the order of two hours of reserve feed at high temperature to minimize composition flucuations in the feed to the combustion zone. Viscosity of the solids-laden bottoms stream from either a shale oil or a coal liquids plant, or process can climb during this hold up period. Hence to assure operability, the cut point, or the temperature of the process steps producing the bottoms streams, must be lowered to include in the bottoms stream lighter liquids that are otherwise more valuable. These lighter liquids have been employed heretofore to decrease the viscosity of the bottoms streams and allow operability of the partial oxidation units but have hurt project economics.

From the foregoing, it can be seen that the prior art has not provided an economical solution to provide relatively low value feed stream for partial oxidation plant and maximize the recovery of valuable lighter ends. In particular, the prior art has not provided a method of disposing of high nitrogen content streams that also alleviates the problems of requiring lower boiling constituents in the bottoms streams to keep the viscosity of these bottoms streams low enough to be feed to a partial oxidation unit as for the production of hydrogen and the like.

SUMMARY OF THE INVENTION

Accordingly, it is an object of this invention to provide a method of removing and disposing of a contaminant, such as nitrogen, from an oil feed stock that reduces the severity of hydrogenation required, reduces the consumption of hydrogen and solves the problem of disposing of the high nitrogen content stream; as well as allowing the feeding economically of a normally viscous bottoms stream into a partial oxidation unit to produce hydrogen for hydrogenation.

It is a particular object of this invention to provide a method of reducing the nitrogenous compounds in an oil stream so as to reduce the reaction severity required and simultaneously to produce a low viscosity bottoms stream that can be combined with the high viscosity stream to improve the economic feasibility of a partial oxidation unit needing low value feed streams to produce hydrogen.

These and other objects will become apparent from the descriptive matter hereinafter, particularly when taken in conjunction with the appended drawings.

In accordance with this invention, there is provided a method of denitrogenating viscous oils containing a relatively high content of nitrogenous compounds and of disposing of a high nitrogen content oil stream, comprising:

a. forming a first portion and a remaining portion of the viscous oil; the remaining portion comprising a first viscous bottoms stream that would not be pumpable to a partial oxidation unit without the inclusion of viscosity lowering constituents;

b. extracting the nitrogenous compounds from the first portion of the viscous oil stream with an operable acid solvent to produce a raffinate of oil having a relatively low concentration of nitrogenous compounds and an extract stream of high content of nitrogenous compounds;

c. recovering the acid solvent from the extract stream, simultaneously producing a small volume stream of low viscosity oil containing a high concentration of the nitrogenous compounds and referred to as a high nitrogen content oil;

d. admixing the low viscosity high nitrogen content oil with the the remaining portion comprising the first high viscosity bottoms to provide a pumpable mixed stream;

e. sending said mixed stream to a partial oxidation unit where hydrogen is produced;

f. employing the hydrogen produced in step e to effect hydrodenitrogenation of the raffinate of step b by hydrogenating the raffinate oil at mild conditions to produce an ultimate product oil stream; and g. recycling the acid solvent to the extracting operation of step b. The operable acid solvent is preferably formic or phosphoric acid or a monoammonium salt of phosphoric acid. The acid solvent is recovered by either distillation or neutralization.

Also, preferably and advantageously, the nitrogenous and sulfurous compounds are converted to ammonia and hydrogen sulfide in the partial oxidation unit and the ammonia and hydrogen sulfide are readily recovered separate and apart from the hydrogen effluent stream and are not released as environmentally deleterious nitrogen or sulfur oxides.

DESCRIPTION OF THE PREFERRED EMBODIMENTS

It is realized, as implied from the descriptive matter hereinbefore, this invention is usable on any oil that has a relatively high concentration of nitrogenous compounds. These oils may be produced from a wide variety of sources. This invention is particularly useful with the oil streams usually referred to as syncrude, such as obtained from oil shale, tar sands and coal.

Figure 1:
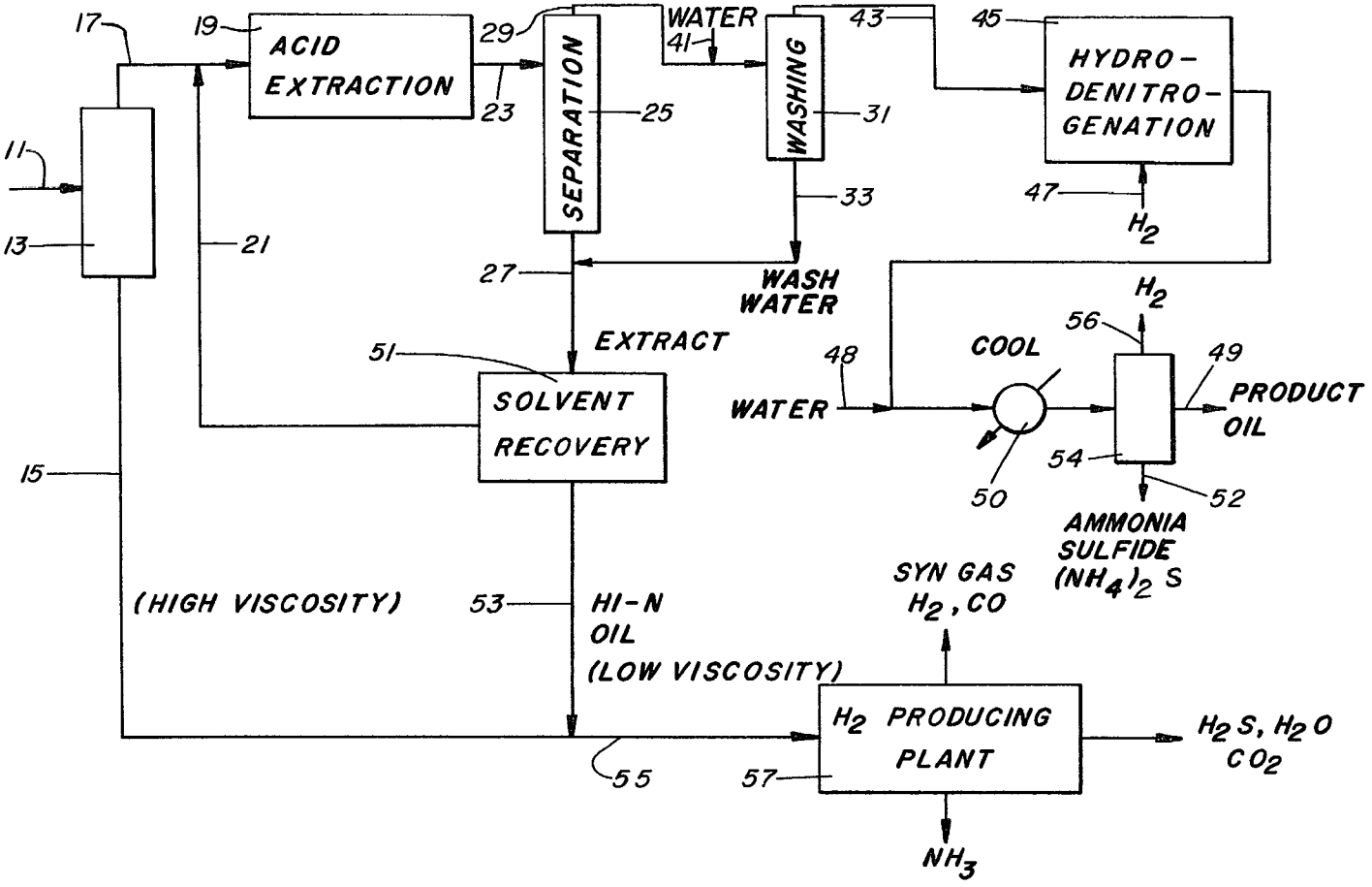
FIG. 1 is a master flow diagram showing broadly the flow of a process in accordance with one embodiment of this invention involving extraction followed by denitrogenation.

Referring to FIG. 1, an incoming stream 11 is treated in a first plant 13. Incoming stream 11 may be a viscous or solid hydrocarbonaceous stream; such as, kerogen, coal, bitumen, tar sand or the like. As indicated and described hereinbefore, the first plant 13 may be a TOSCO plant that produces a very viscous quench tower bottoms stream 15 as well as an overhead stream 17; or the first plant 13 may comprise an EDS plant that produces a very viscous vacuum bottoms stream 15 and overhead stream 17. In either case, it is useful to send the bottoms stream to a partial oxidation plant for production of synthesis gas, hydrogen gas, or the like. The bottoms stream 15 is ordinarily a solid at room temperature and is so "gunky" and viscous that it cannot be pumped without the addition of light ends. Consequently, as indicated hereinbefore, in the past the boiling point separation has been lowered to include from five to twenty percent of the valuable light ends that would otherwise be in the overhead stream 17. In accordance with this invention the first plant 13 is operated so as to produce these valuable light ends in stream 17 and to produce in stream 15 a viscous bottoms that would solidify upon cooling and storing during temporary holdup as reserve feed if a less viscous and soluble stream were not added.

The overhead stream 17, or other similar feed oil stream may comprise an inlet stream to the acid extraction unit 19. As illustrated, an acid solvent stream 21 is admixed with the incoming oil stream 17 before coming into the acid extraction unit 19. The effluent stream 23 is sent to a separation tower 25. The acid solvent admixes with the feed oil stream and extracts, or dissolves, the nitrogenous compounds. Most of the nitrogenous compounds are extracted by the acid solvent and fall, with any excess acid solvent, by gravity to the lower portion of the separation tower 25 where they are withdrawn as a stream of extract, 27. The extract stream 27 is high in concentration of the nitrogenous compounds. Consequently, there is also produced a raffinate stream 29 of oil that is relatively low in concentration of nitrogenous compounds. Specifically, the raffinate is at least twenty percent (20%) lower in the concentration of nitrogenous compounds than in the feed oil stream 17.

Following separation, the raffinate oil stream 29 is then passed through a washing tower 31 after a water stream 41 has been added to the oil. The oil is washed and the washed, low-nitrogen oil stream 43 is passed to the hydro-denitrogenation unit 45. An incoming hydrogen stream 47 is also sent to the hydro-denitrogenation unit 45. In the hydro-denitrogenation unit, the hydrogenation is carried out and the nitrogenous compounds are removed in accordance with conventional technology. Consequently, there is an effluent stream 49 that is a product oil containing a low concentration of nitrogenous compounds. The hydro-denitrogenation unit 45 can be a mild hydrogenation vessel with low severity conditions because of the relative ease of hydrogenation and the relatively low content of the nitrogenous compounds in the incoming stream 43 to the hydro-denitrogenation unit 45.

In the hydrogenation unit 45, there is produced ammonia and hydrogen sulfide as byproducts. The oil containing these byproducts is washed with water in stream 48 and cooled in heat exchanger 50. Preferably, the heat exchanger 50 is a water cooled heat exchanger, although any other suitable heat exchanger could be employed. The ammonia and hydrogen sulfide are dissolved and reacted to provide a bottoms stream 52 that includes an aqueous solution of ammonium sulfide, among other components. Gaseous hydrogen is taken off the flash tower 54 in stream 56 and recycled. The oil product with the nitrogenous compounds removed, at least to a satisfactorily low concentration, passes out line 49 as the desired product oil.

The bottoms from the washing tower 31 comprises wash water stream 33 containing acid and the like that has been washed from the raffinate oil stream 29. The wash water stream 33 is added to the bottoms stream 27 from the separation tower 25 and sent to the solvent recovery unit 51.

In the solvent recovery unit 51, the acid solvent is recovered and sent by the acid solvent conduit 21 to be recycled. An oil stream containing a high concentration of nitrogenous compounds, commonly referred to as a high-nitrogen content oil or, in FIG. 1 as a HI-N OIL, stream 53 is produced. The high nitrogen content oil is then passed to and admixed with the viscous bottoms stream 15 to produce a liquid stream pumpable at a reasonable temperature, preferably 450° F. to 550° F. The admixed, pumpable liquid 55 is then sent to a partial oxidation plant, also referred to as a hydrogen ($H_2$) producing plant, 57.

As is recognized, the hydrogen producing plant 57 is a partial oxidation plant that produces synthesis gas (hydrogen and carbon monoxide), hydrogen sulfide, carbon dioxide, and ammonia. The synthesis gas is separated as the desired stream. The carbon monoxide in the synthesis gas is frequently reacted with water to produce more hydrogen for the hydrogenation. Other products such as the ammonia can be recovered or interreacted as the market makes most profitable at a given time.

Figure 2:
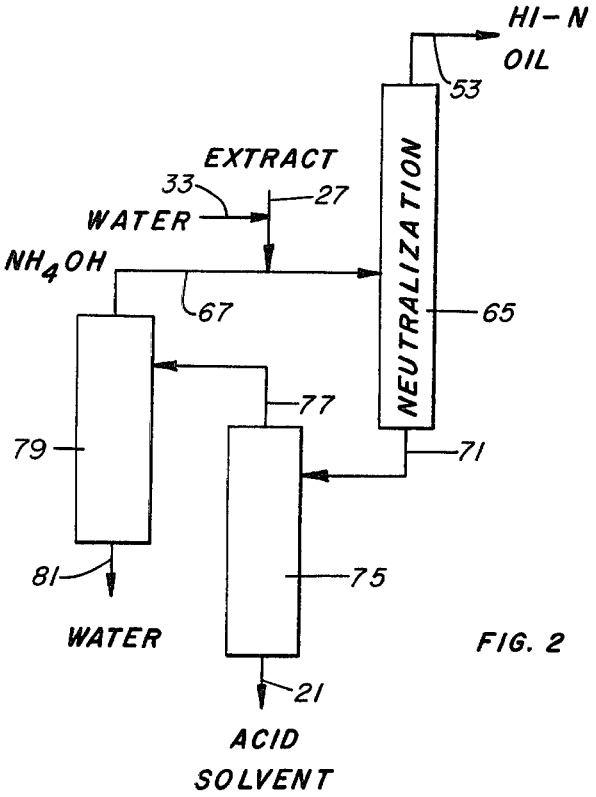
FIG. 2 is a flow diagram showing the recovery of acid solvent by neutralization.
Figure 3:
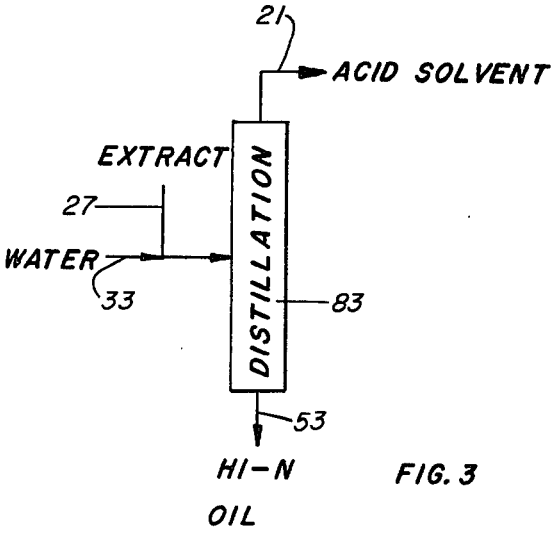
FIG. 3 is a flow diagram showing recovery of the acid solvent by distillation.

The solvent recovery unit may comprise either a neutralization unit, such as illustrated in FIG. 2, or a distillation unit, such as illustrated in FIG. 3, depending in part upon the acid solvent employed. As indicated hereinbefore, the acid solvent may be either phosphoric acid or a monoammonium salt of phosphoric acid either of which would be recovered by neutralization, or formic acid which boils at 213° F. and is sufficiently volatile to be recovered by distillation alone.

As can be seen in FIG. 2, the extract stream 27 has ammonium hydroxide added to it and is sent to the neutralization vessel 65. Wash water may have been added through stream 33. The ammonium hydroxide is added via conduit 67. The overhead stream 53 is the high nitrogen content oil stream delineated with respect to FIG. 1 hereinbefore. If desired, the overhead stream 53 may be washed with water before it is sent to be admixed with the viscous bottoms stream 15, FIG. 1.

The bottoms stream 71 from the neutralizing vessel 65, FIG. 2, is sent, alone or with any wash water from washing of the high nitrogen oil stream 53, to the phosphoric acid recovery tower 75. Where phosphoric acid or the monoammonium salt of phosphoric acid is employed as the acid solvent, the resulting solution in the stream 71 includes di-ammonium phosphate solution. In the phosphoric acid recovery tower 75, the ammonia and some water are recovered from the acid solvent and sent by conduit 77 to a separator, or concentrator, 79. The overhead stream of ammonium hydroxide is then passed by conduit 67 to be added to the extract stream 27 before the neutralization tower 65. The bottoms is waste water 81.

The bottoms from the acid recovery unit 75 is the acid solvent that is sent by conduit 21 to be recycled to the acid extraction unit 19.

If, on the other hand, the acid solvent employed is formic acid, the extract stream 27, FIG. 3, to which has been added any water stream 33, is sent to the distillation tower 83. The overhead of the distillation tower is the acid solvent which is sent by conduit 21 to be recycled. The bottoms for the distillation tower is the oil containing the high concentration of the nitrogenous compounds, stream 53, FIG. 1. The high nitrogen content oil stream 53 is then sent to the partial oxidation plant 57 after being admixed with the viscous bottoms stream 15, as indicated hereinbefore.

Figure 4:
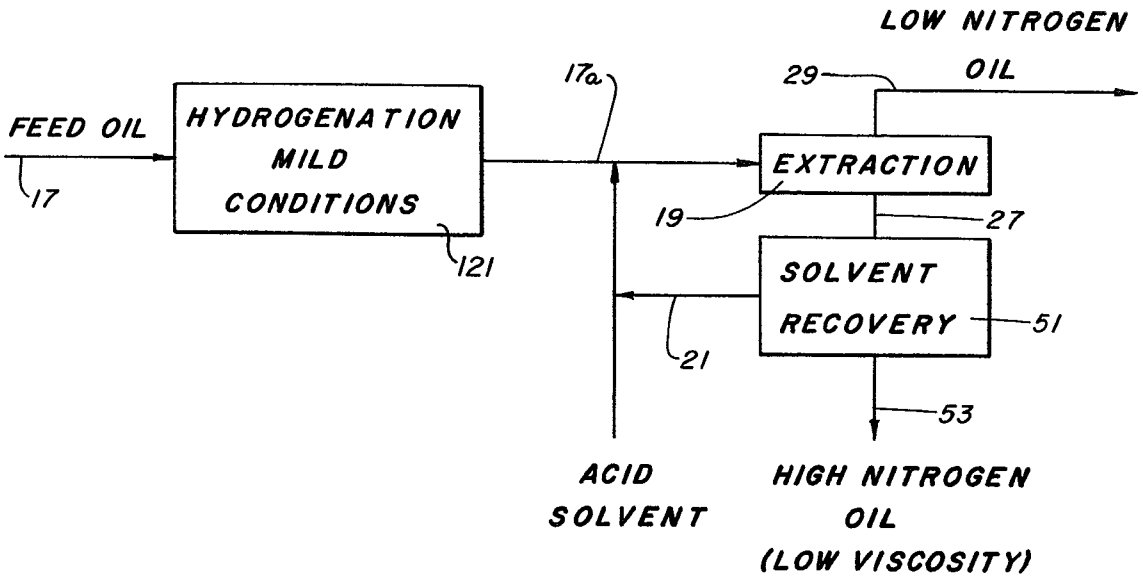
FIG. 4 is a master flow diagram showing broadly the flow of a process in accordance with a second embodiment of this invention involving denitrogenation followed by extraction.

FIG. 4 illustrates the invention employing hydrodenitrogenation followed by extraction. The extraction process for hydrotreated oils is essentially the same as that for the unhydrotreated oil shown in FIG. 1. The oil feed stream **17*a* has, however, a lower nitrogen content than the raw oil; and, hence, less acid is required for extraction and less high nitrogen oil is removed. Specifically feed oil stream 17 is subjected to hydrogenation in hydrogenation tower 121. The hydrogenation is mild; for example, in the presence of a conventional nickel-molybdenum hydrotreating catalyst at low temperature, high space velocity. The concentration of nitrogenous compounds is reduced. Moreover, the initial hydrogenation, or hydrotreating, is additionally advantageous in that there is less tendency to form troublesome "gunky" residue and there is a smaller high nitrogen content oil stream than with extraction first. In any event, the effluent stream 17*a*** is the feed stream for the remainder of the process (as described with respect to FIGS. 1-3).

EXAMPLE

A process similar to that shown in FIG. 1 is carried out using a syncrude feed composed of a shale oil formed from Colorado oil shale which contained about 2.0 percent by weight of nitrogenous compounds.

The syncrude feed is mixed with an aqueous phosphoric acid solution containing 42.5 weight percent phosphoric acid. Equal weights of the phosphoric acid solution and the syncrude feed are admixed. The mixing is carried out at about 100° F. and atmospheric pressure for 15 minutes. After admixing, the admixture is passed to a separator and allowed to set for 30 minutes at quiescent conditions. Two phases formed. The overhead, or raffinate, phase of lesser density is a low nitrogen syncrude containing less than 1.0 percent by weight nitrogen compounds and substantially free of acid. The second phase contains essentially all of the acid and the high nitrogen syncrude phase contains about 4.7 percent by weight nitrogen. The low nitrogen syncrude phase is removed from the separator and subjected to mild hydrogenation to produce a satisfactory oil product.

The high nitrogen syncrude phase containing any excess acid is transferred to a neutralizer wherein an aqueous solution containing 58 percent by weight ammonium hydroxide is added. The ammonium hydroxide solution is added in the amount of about 15.3 percent by weight based on the total weight of the high nitrogen syncrude phase. The mixture is then transferred to a separator and separated. The overhead phase is a high nitrogen content oil that has a low viscosity in the range of 1-100 centipoises at room temperature. It is admixed with a very viscous quench tower bottoms stream having a viscosity in the range of 25 centipoises (cp) at 350° F., 150 cp at 270° F. and solid at room temperature.

The proportion is about 15% by weight of the high nitrogen oil in the total stream. As a result the total admixture is pumpable to a holding tank for two hours and then on to a partial oxidation unit for producing hydrogen, as well as other byproducts.

As can be seen from the foregoing, this invention achieves the objects delineated hereinbefore and alleviates the deficiencies of the prior art. In particular, this invention can be employed where there is an extraction of the nitrogenous compounds before the hydrotreating, or with a partial hydrotreating before the extraction. For example, in the latter case the extraction allows ending up with the majority of the nitrogenous compounds in only a small stream of about three percent (3%) of the original oil stream. This small stream may contain a concentration of from three to five percent (3-5%) of the nitrogenous compounds but because of its nitrogen content it is of poor quality and of low value as a product stream. It has a relatively low viscosity and a low boiling point. Because of its low viscosity, it can be added to the highly viscous bottoms stream 15 from the plant 13 in an operable stream 55 to the partial oxidation unit, thus allowing recovery in stream 17 of valuable light ends, or low boiling constituents from the coal liquids, from the shale oil streams or the like produced from the plant 13.

Of course, the combined stream of the bottoms and the high nitrogen content oil can be combined and used in any other type unit deemed advisable under the market conditions. The partial oxidation unit as a hydrogen producing plant, is shown in this embodiment because it is ordinarily in this context that the streams will be employed.

Thus, this invention enables hydrogenating the main oil stream at mild conditions as well as enabling recovering the valuable light ends and still dilute the viscosity of the bottoms so as to be a pumpable mixed stream.

Having thus described the invention, it will be understood that such description has been given by way of illustration and example and not by way of limitation, reference for the latter purpose being had to the appended claims.

I claim:

1. A method of denitrogenating a viscous oil containing a relatively high content of nitrogenous compounds and of disposing of the extract oil stream containing a high concentration of the nitrogenous compounds extracted, comprising:

a. forming a first portion and a remaining portion of the viscous oil stream; said remaining portion comprising a first viscous bottom stream that would not be operably pumpable to a partial oxidation unit without the inclusion of viscosity lowering constitutents;

b. extracting the nitrogenous compounds from said first portion of the viscous oil with an operable acid solvent to produce a raffinate oil having a relatively low concentration of nitrogenous compounds such that said raffinate oil can be hydrodenitrogenated at mild conditions with reduced hydrogen consumption; and an extract stream of high content of nitrogenous compounds;

c. recovering the acid solvent from said extract stream, simultaneously producing a small volume stream of low viscosity oil containing a high concentration of nitrogenous compounds and referred to as a high nitrogen content oil;

d. admixing said low viscosity high nitrogen content oil with the remaining portion of said viscous oil comprising said first viscous bottoms stream to provide a pumpable mixed stream;

e. sending said mixed stream to a partial oxidation unit where hydrogen is produced;

f. employing the hydrogen produced in step e to effect hydrodenitrogenation of the raffinate oil by hydrogenating the raffinate oil at mild conditions to produce an ultimate product oil stream; and g. recycling said acid solvent to the extracting operation of step b.

2. The method of claim 1 wherein said oil is subjected to hydrogenation to lower the concentration of the nitrogenous compounds before the extracting of step b.

3. The method of claim 1 wherein said acid solvent is selected from the class consisting of phosphoric acid, formic acid, and a monoammonium salt of phosphoric acid.

4. The method of claim 3 wherein said acid solvent comprises formic acid.

5. The method of claim 1 wherein said acid solvent recovery is by distillation of the bottoms into respective acid solvent and high nitrogen content oil streams.

6. The method of claim 1 wherein said acid solvent recovery is by neutralization.

7. The method of claim 6 wherein said neutralization is with ammonium hydroxide and produces an extract oil that is washed and the bottom wash is combined with the bottoms from the neutralization to produce a solution from which the acid solvent is recovered and recycled, simultaneously producing ammonium hydroxide which is also recycled to the neutralizing reactor.

8. The method of claim 1 wherein said high nitrogen content oil stream is washed with water before being sent onto its destination in accordance with step c.

9. The method of claim 1 wherein said raffinate oil having low concentration of nitrogenous compounds is washed with water before being sent to hydronitrogenation.

10. The method of claim 1 wherein said raffinate oil is sent to a mild hydrodenitrogenation unit where the nitrogenous compounds are converted to ammonia and the sulfur compounds are converted to $H_2S$ and said ammonia and $H_2S$ are removed from the product oil stream.

11. The method of claim 1 wherein said oil also contains sulfurous contaminants as well as the nitrogenous contaminants and said nitrogenous and sulfurous contaminants are converted to ammonia and hydrogen sulfide in the partial oxidation unit and the ammonia and hydrogen sulfide are recovered separately from said hydrogen to alleviate difficulties with said ammonia and hydrogen sulfide in the effluent streams.

* * * * *